United States Patent [19]

Skala

[11] 4,024,904

[45] May 24, 1977

[54] FORCED AIR RANGE WITH THERMAL EXCHANGE FLUID

[76] Inventor: Stephen E. Skala, 3839 S. Wenonah Ave., Berwyn, Ill. 60402

[22] Filed: May 13, 1975

[21] Appl. No.: 577,109

[52] U.S. Cl. ..... 165/2; 62/263; 62/409; 165/12; 165/50

[51] Int. Cl.[2] ..... F25B 13/00

[58] Field of Search ..... 165/18, 14, 50, 2, 26, 165/22, 48, 12; 62/263, 409

[56] References Cited

UNITED STATES PATENTS

| | | | |
|---|---|---|---|
| 1,053,443 | 2/1913 | Scott | 62/409 |
| 1,853,490 | 4/1932 | Anderson | 62/263 |
| 3,242,980 | 3/1966 | Bemiss et al. | 165/50 |
| 3,260,304 | 7/1966 | Rabechault | 165/12 |
| 3,608,627 | 9/1971 | Shevlin | 165/12 |

*Primary Examiner*—C. J. Husar
*Assistant Examiner*—Daniel J. O'Connor

[57] ABSTRACT

A forced air range is part of a domestic appliance system which includes hot and cold thermal reservoirs. A thermal exchange fluid can circulate between a heat exchanger in one of the thermal reservoirs and a heat exchanger within a duct in the forced air range. For operation, an ordinary houseware such as a pot, is placed on the range and temperature and heating rates are programmed. A blower circulates air through the heat exchanger and under the houseware. Thermal exchange fluid flows through the heat exchanger to maintain the circulating air at the programmed temperature.

3 Claims, 1 Drawing Figure

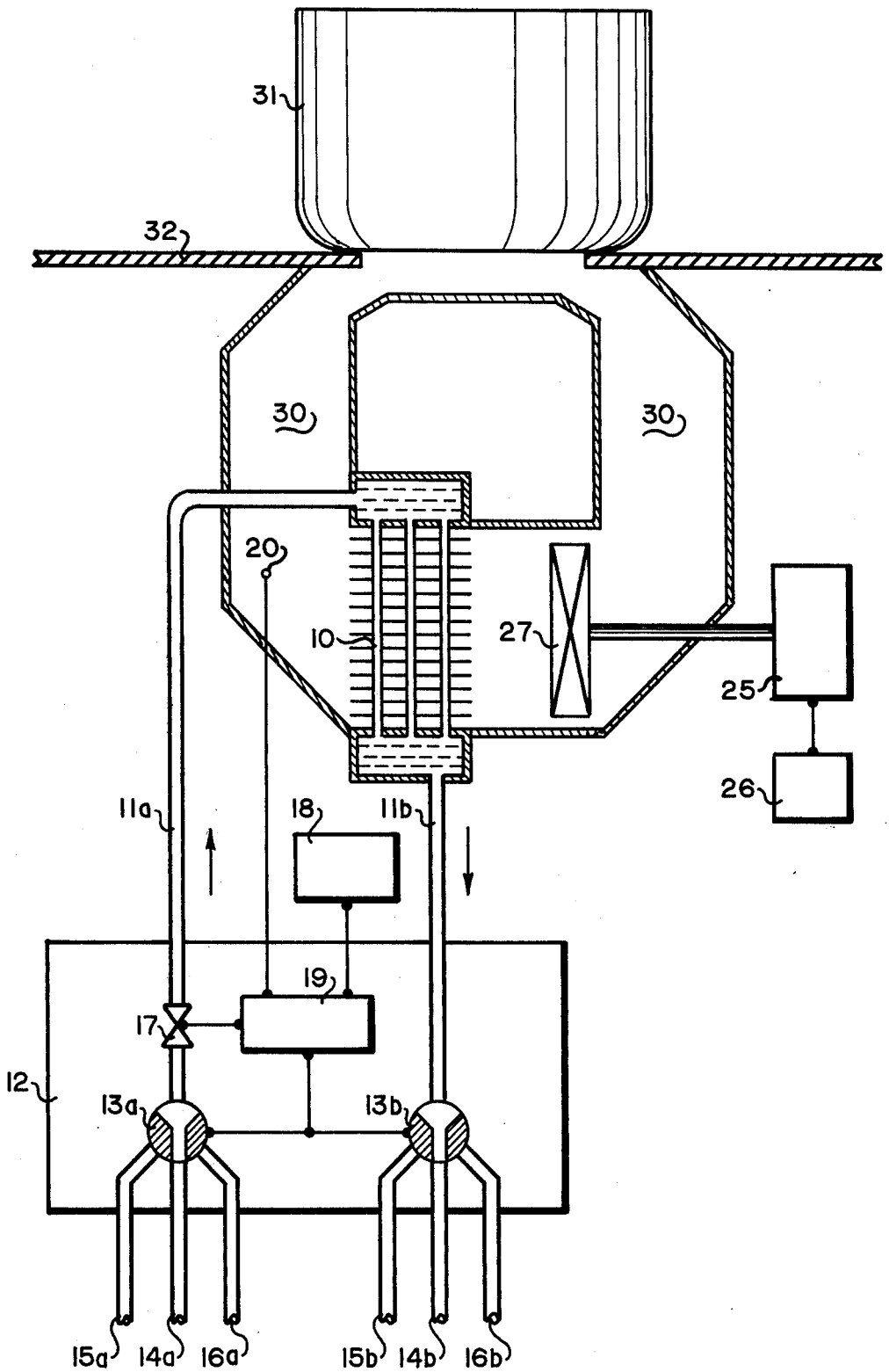
31
32
30
30
20
10
27
25
26
11a
18
11b
19
17
12
13a
13b
15a
14a
16a
15b
14b
16b

FORCED AIR RANGE WITH THERMAL EXCHANGE FLUID

This invention relates to cooking and more particularly it relates to cooking by forced air heat exchange between a houseware and a thermal exchange fluid.

BACKGROUND

This invention is part of a domestic appliance system disclosed in a copending application Ser. No. 299,214 now U.S. Pat. No. 3,888,303 and in copending application Ser. No. 567,647 wherein each appliance is heated or cooled by a thermal exchange fluid which has a regulated flow between the appliance and one of several thermal reservoirs which are maintained at hot, cold, or ambient temperatures. In this domestic appliance system, many components such as the thermal reservoirs along with pumps and supply and return mains are commonly shared and particular associated appliances tend to be more passive and economical than corresponding conventional appliances. Yet large thermal capacity of the system and selection among thermal exchange fluids are different temperatures improves performance and versatility.

Conventional flame and electric heating elements have a high temperature and low heat content. Solid foods can be scorched, yet liquids heat slowly. A stove top heater with thermal exchange fluid such as is disclosed by A.N.A. Axlander in U.S. Pat. No. 3,543,001 can increase available heat but heat transfer is limited by inadequate thermal contact between the stove top and a houseware. The method of forced circulation of thermal exchange fluid through connectable housewares disclosed in the cited U.S. Pat. No. 3,888,303 provides high heat capacity, effective heat transfer, and control a wide range of temperatures. Special housewares are required, however, and it would be desirable to provide such advantages for ordinary housewares.

OBJECTS

It is a general object of this invention to provide an improved cooking range.

It is another object of this invention to provide a range which transfers heat rapidly over a wide range of temperatures.

It is yet another object of this invention to provide a range which can be ordinary housewares.

It is still another object of this invention to provide a range which is part of a domestic appliance system with thermal exchange fluid and thermal reservoirs.

SUMMARY

These objects, along with other objects and advantages which will become apparent, are attained by the present invention wherein forced circulating air transfers heat between a heat exchanger and a houseware. The heat exchanger receives a regulated flow of thermal exchange fluid at one of several temperatures: hot, cold, or ambient. Thermal reservoirs which exchange heat with the thermal exchange fluid have large thermal capacity and rapidly circulating air effectively transfers heat to the houseware. Capability of selecting the temperature of the thermal exchange fluid and of regulating the temperature of the circulating air provides functions and a degree of control which is not possible with conventional ranges. Examples are: Moderate hot air temperatures avoid scorching of food. Air circulating at ambient temperature can cool food such as soup or coffee to serving temperature. Cold circulating air can freeze food which is useful for such applications as making ice cream. Another use of cold air is storage of food within an insulated pot until a preselected time at which a programmed cooking cycle can begin with hot circulating air.

DESCRIPTION OF THE PREFERRED EMBODIMENTS

The drawing is a side sectional view of the improved forced air range and a schematic drawing of a flow selector and regulator for thermal exchange fluid.

Referring to the drawing, a heat exchanger 10, which can be of conventional design with spaced fins in thermal contact to tubes through which thermal exchange fluid can flow, is connected to a source of thermal exchange fluid by supply line 11*a* and return line 11*b*. A flow selector and regulator 12 includes a pair of electrically operated selector valves 13*a* and 13*b* which select a pair of supply and return lines such as 14*a* and 14*b* which are shown connected. The supply and return lines 14*a* and 14*b*, 15*a* and 15*b*, and 16*a* and 16*b* continue so that each pair forms a closed loop, not shown, which includes a heat exchanger within a thermal reservoir and a pump. One heat exchanger heats thermal exchange fluid to approximately +500° F, one cools to approximately −20° F, and one moderates to ambient temperature.

An electrically operated regulator valve 17 regulates flow of thermal exchange fluid to control temperature of air flowing through heat exchanger 10. A programmer 18 stores information for temperature as a function of time and, at appropriate times, transmits a signal to controller 19 which operates the selector valves and the regulator valve to control temperature at temperature sensor 20 to the valve demanded by the programmer.

A motor 25 operated by a controller 26 which is responsive to programmer 18 drives blower 27 which forces air to circulate within a duct generally indicated as 30. The circulating air transfers heat between heat exchanger 10 and a houseware 31 resting on range top 32.

The claims of the invention are now presented, and the terms of such claims may be further understood by reference to the preceeding drawing and the language of the preceeding specification.

What is claimed is:

1. In a method for transferring heat to food in a houseware unit in a domestic appliance from hot and cold thermal reservoirs in a heat exchange relation with thermal exchange fluid which moves in connecting lines between said thermal reservoirs and a heat exchanger in said domestic appliance, said domestic appliance having means for circulating and regulating flow of said thermal exchange fluid between one of the thermal reservoirs and said heat exchanger to control temperature within said domestic appliance, including the steps of communicating a portion of said houseware unit within a duct of said domestic appliance, regulating flow of said thermal exchange fluid through said heat exchanger positioned within the duct to control temperature within said duct, and circulating air through said heat exchanger and across said portion of said houseware unit within the duct to exchange heat between the heat exchanger and the houseware unit.

2. The method of claim 1 wherein the thermal exchange fluid is selected from thermal reservoirs at hot, cold, or ambient temperatures and flows through a single heat exchanger within said domestic appliance.

3. The method of claim 1 wherein velocity of the circulating air is regulated by controlling speed of a blower.

* * * * *